US005154622A

United States Patent [19]

Ehrentraut et al.

[11] Patent Number: 5,154,622

[45] Date of Patent: Oct. 13, 1992

[54] MULTIPIN PLUG FOR THE JOINT ELECTRICAL CONTACTING OF A PLURALITY OF ELECTRICALLY EXCITABLE ELEMENTS OF INTERNAL COMBUSTION ENGINES

[75] Inventors: Heinz Ehrentraut, Stuttgart; Udo Hafner, Ludwigsburg; Helmut Bassler, Weinstadt; Ferdinand Reiter, Markgröningen, all of Fed. Rep. of Germany

[73] Assignee: Robert Bosch GmbH, Stuttgart, Fed. Rep. of Germany

[21] Appl. No.: 768,962

[22] PCT Filed: Jan. 19, 1991

[86] PCT No.: PCT/DE91/00044

§ 371 Date: Oct. 9, 1991

§ 102(e) Date: Oct. 9, 1991

[87] PCT Pub. No.: WO91/12425

PCT Pub. Date: Aug. 22, 1991

[30] Foreign Application Priority Data

Feb. 9, 1990 [DE] Fed. Rep. of Germany ..... 4003958

[51] Int. Cl.[5] ..... H01R 13/447

[52] U.S. Cl. ..... 439/130; 123/470

[58] Field of Search ..... 439/130, 246; 123/168, 123/170

[56] References Cited

FOREIGN PATENT DOCUMENTS 0278229 8/1988 European Pat. Off. ..... 439/130

*Primary Examiner*—Eugene F. Desmond

*Attorney, Agent, or Firm*—Edwin E. Greigg; Ronald E. Greigg

[57] ABSTRACT

A multipin plug including plug housings which are connected in a floatingly movable manner in the horizontal and vertical direction to one central floor part of a receiving opening of the multipin plug so that offsets occurring between the first and the second electrically conductive contacting elements are compensated and damage is avoided. Such a multipin plug is particularly suitable for electrically connecting fuel injection valves to the multipin plug.

27 Claims, 4 Drawing Sheets

MULTIPIN PLUG FOR THE JOINT ELECTRICAL CONTACTING OF A PLURALITY OF ELECTRICALLY EXCITABLE ELEMENTS OF INTERNAL COMBUSTION ENGINES

PRIOR ART

The invention is based on a multipin plug of type set forth in DE-OS 37 30 571. The German patent already discloses a device in which the fuel injection valves are received in individual receiving openings of a fuel distributor element and are jointly electrically contacted by means of a multipin plug. A number of plug housings, corresponding to the number of fuel injection valves, in which first electrically conductive contacting elements which can be connected to second electrically conductive contacting elements of the fuel injection valves are arranged rigidly connected to the multipin plug. Since the receiving openings in the fuel distributor element, the receptacles of the plug housings in the multipin plug and the first electrically conductive contacting elements mounted in the plug housings and the second electrically conductive contacting elements of the fuel injection valves have shape and position tolerances, when connecting the multipin plug to the fuel injection valves, an offset occurs between the second electrically conductive contacting elements of the fuel injection valves and the first electrically conductive contacting elements of the plug housings arranged in the multipin plug. If the multipin plug, the fuel distributor element and the plug housings are formed from plastic, particularly large shape and position tolerances due to manufacture are to be expected. There is then the risk during assembly of a deformation or damaging of the first electrically conductive contacting elements and of the second electrically conductive contacting elements and/or of the multipin plug, the plug housings and/or the fuel injection valves. Reliable functioning of the known device after the connection of fuel injection valves and multipin plug is therefore then not guaranteed. In addition, the offsets between the second electrically conductive contacting elements of the fuel injection valves and the first electrically conductive contacting elements of the multipin plug lead to a requirement for high joining forces between the contacting elements.

ADVANTAGES OF THE INVENTION

The multipin plug according to the invention has, in contrast with the above, the advantage that the plug housings which are mounted in the multipin plug in a floatingly movable manner in the horizontal and in the vertical direction permit a compensation of the shape and position tolerances between the jointly contacted, electrically excitable elements and the multipin plug. The plug housings which are still movable after mounting in the multipin plug can thus be aligned in accordance with the position of the second electrically conductive contacting elements of the electrically excitable elements in the multipin plug. As a result, a connection of the multipin plug, having the plug housings, to the electrically excitable elements is produced with relatively small deformations and joining forces between the first electrically conductive contacting elements of the multipin plug and the second electrically conductive contacting elements so that damage during the joining process both to the multipin plug and to the electrically excitable elements is effectively prevented.

A device with the features set forth herein permits a joint electrical contacting of fuel injection valves arranged in a fuel distributor element with the advantages already specified previously. The offsets occurring due to shape and position tolerances and as a result of the receiving openings of the fuel distributor element, the fuel injection valves, the first and the second electrically conductive contacting elements and the plug housings are compensated by the plug housings which are mounted in the multipin plug in a floatingly movable manner in the horizontal and in the vertical direction.

By means of the measures specified, advantageous further developments and improvements of the multipin plug disclosed are possible.

In order to construct a plug housing which is floatingly movable in the multipin plug in the horizontal and in the vertical direction, it is advantageous if a holding element is mounted on the multipin plug which engages through an opening of the plug housing with radial play and at an axial distance, and with a head delimits the axial mobility of the plug housing with respect to the multipin plug.

For a particularly simple connection of plug housing and multipin plug, it is advantageous if the plug housing is held, by means of the holding element mounted in a blind hole of the central floor part, on a central floor part of a receiving opening of the multipin plug constructed to receive the plug housing.

However, an advantageous connection is also produced if the plug housing is inserted into a receiving opening of the multipin plug constructed to receive the plug housing and is connected by means of a snap-in or lock-in connection to the multipin plug.

It is particularly advantageous if at least one positioning projection which determines the position of the element or of the fuel injection valve with respect to the plug housing is constructed on the plug housing and extends from the circumference of the plug housing in the axial direction of the receiving opening and cooperates with at least one recess arranged on the element or fuel injection valve so that a simple and exact positioning of the element or of the fuel injection valve with respect to the plug housing is obtained. A deformation or damaging of the first electrically conductive contacting elements of the plug housings or of the second electrically conductive contacting elements of the element or of the fuel injection valve is thus effectively prevented.

However, it is also advantageous for a simple and exact positioning of the element or of the fuel injection valve with respect to the plug housing if at least one recess which cooperates with at least one positioning projection formed onto the element or fuel injection valve is constructed on the plug housing.

An asymmetrical design, with respect to a multipin plug longitudinal axis of the multipin pin, of at least two positioning projections and at least two recesses on the element or the fuel injection valve and on the plug housing has the advantage that when connecting the first electrically conductive contacting elements of the plug housing to the second electrically conductive contacting elements of the element or of the fuel injection valve the said projections and recesses only permit an exact positioning of the element or of the fuel injection valve with respect to the plug housing and thus serve as a polarity reversal protection for the electrical contact.

For reasons of an economical manufacture and electrical insulation, it is advantageous to construct the multipin plug and the plug housings from plastic. The large shape and position tolerances due to production occurring when plastics are used can be compensated by the horizontally and vertically movable plug housings. In a rigid plug housing arrangement, such as described in DE-OS 37 30 571, no compensation of the large tolerances which occur is possible so that use of a multipin plug constructed from plastic is problematic.

It is particularly advantageous if the first electrically conductive contacting elements can be mounted in plug openings of the plug housing by engaging locking noses constructed on the first electrically conductive contacting elements so that a simply made and reliable connection is produced between the first electrically conductive contacting elements and the plug housing.

In order to fix the position of an electrical conductor which runs in the multipin plug constructed from plastic and is electrically conductively connected to the first electrically conductive contacting elements, it is advantageous, if the electrical conductor is connected to the multipin plug.

It is particularly advantageous if the electrical conductor is connected at at least one support point of the multipin plug to the multipin plug by caulking multipin plug material by means of ultrasonic welding so that a simply made and reliable connection between the electrical conductor and the multipin plug is produced.

In order to construct a compact injection system according to the invention which entails low manufacturing costs it is advantageous if the fuel distributor element is so to speak integrated in the manifold or in the cylinder head of an internal combustion engine, that is to say that the required fuel lines and valve receiving openings are present there.

DRAWING

Exemplary embodiments of the invention are illustrated in simplified form in the drawing and explained in greater detail in the subsequent description. FIG. 1 and FIG. 2 show a multipin plug designed according to the invention, FIG. 3 shows a mounting of the plug housing, designed according to the invention, on the multipin plug along the section line III—III in FIG. 2, FIG. 4 and FIG. 5 show an upper housing component of a fuel injection valve which can be connected to the plug housing and FIG. 6 shows a fuel distributor element with fuel injection valves which are arranged therein and are jointly electrically contacted by a multipin plug.

DESCRIPTION OF THE EXEMPLARY EMBODIMENTS

Figure 1:
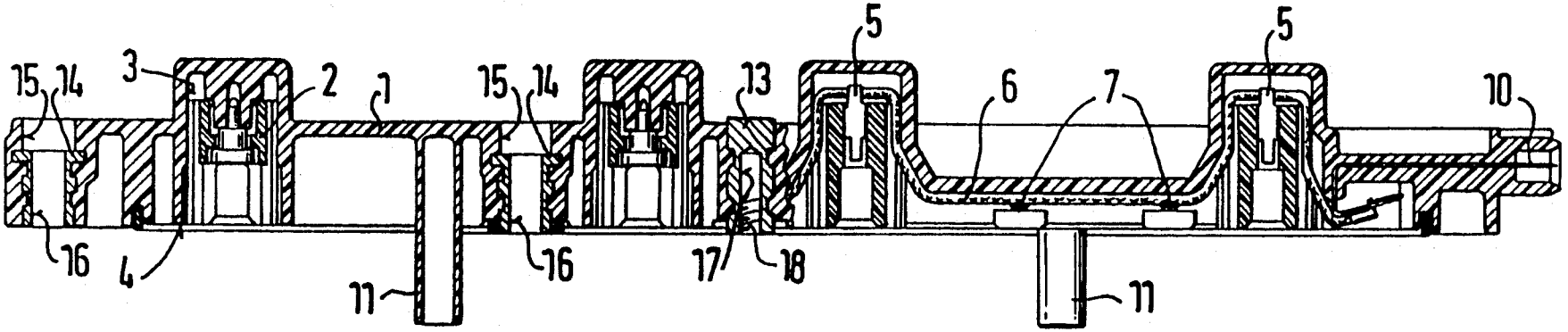

In the multipin plug illustrated by way of example in FIGS. 1 to 6 for the joint electrical contacting of a plurality of electrically excitable elements of internal combustion engines, the multipin plug constructed by way of example as a plastic injection moulded component is designated by 1. Plug housings 2 which are each assigned to an electrically excitable element and serve for its electrical contacting are arranged in the multipin plug 1. For this purpose, a blind hole-shaped receiving opening 3 is provided in the multipin plug 1 for each plug housing 2, which opening is open towards a multipin plug endface 4. In the plug housing 2 produced from electrically insulating material, first electrically conductive contacting elements 5 are arranged which are electrically conductively connected to electrical conductors 6 arranged in the multipin plug 1. The electrical conductors 6 can be constructed, for example in a belt shape and are connected to the multipin plug 1 for example by, in each case, a support point 7 located between each receiving opening 3, each support point 7 being formed by caulking multipin plug material by means of ultrasonic welding.

For example, arranged at one of the ends in the longitudinal direction on the multipin plug 1 is also a connection plug 10 to which the individual electrical conductors 6 are connected and via which electrical drive signals for the electrically excitable elements can be fed from an electronic control unit (not illustrated) of a known design. Thus, all the electrical conductors 6 originate from the connection plug 10 and run to the individual plug housings 2 within the multipin plug 1 and branch there to the individual first electrically conductive contacting elements 5. Two guide arms 11 which are preferably formed during the manufacture of the multipin plug 1 project out of the multipin plug endface 4 with axial spacing from one another. In order to connect the multipin plug 1, for example to a fuel distributor element, a manifold or a cylinder head of an internal combustion engine, mounting bushings 13, 14 are formed during manufacture in the multipin plug illustrated as an exemplary embodiment, which bushings are open on at least their side facing the multipin plug endface 4. The mounting bushings 13, 14 are constructed for example from a metallic material. The mounting bushing 13 has a blind hole 17 which is provided with an inner thread 18 whilst the mounting bushings 14 which are open towards both sides construct mounting openings 16 in the multipin plug 1 in conjunction with the multipin openings 15 of the multipin plug 1 which are concentric to the mounting bushings 14.

Figure 3:
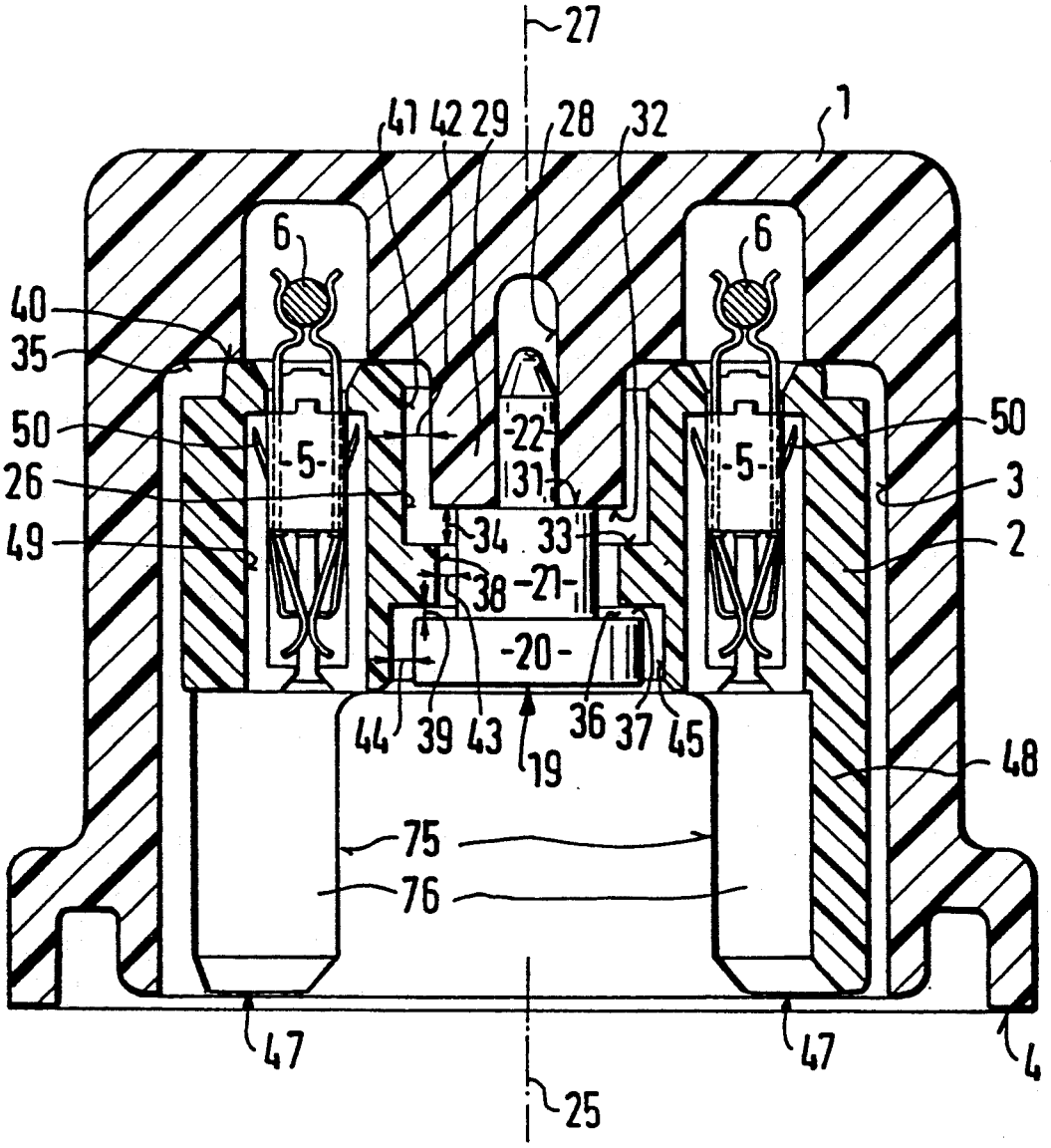

In FIG. 3, an example of a connection according to the invention of plug housing 2, for example made from plastic, and the multipin plug 1 constructed from plastic is illustrated in greatly enlarged form. A stepped holding element 19, which is made for example from plastic and has originating from a head 20 a centre region 21, which has a smaller diameter than the head 20, and a tip 22 which has a smaller diameter than the centre region 21, is guided through a stepped opening 26 of the plug housing 2 constructed concentrically to a plug longitudinal axis 25 of the plug housing 2 and plugged with its tip 22 into a blind hole 28, running concentrically to a receiving longitudinal axis 27 of the receiving opening 3 of the multipin plug 1, of a central floor part 29 of the receiving opening 3 and connected in the illustrative exemplary embodiment to the blind hole 28 by means of ultrasonic welding in such a way that the holding element 19 rests with a first element shoulder 31 of the central region 21 in the axial direction against an endface 32 of the central floor part 29. The central floor part 29 projects in the axial direction with respect to the floor 35 of the receiving opening 3 of the multipin plug 1 and has, for example, a circular-shaped cross-sectional area.

In order to connect plug housing 2 to the multipin plug 1 it is also possible for the tip 22 of the holding element 19 to be provided on its circumference with a thread and is screwed into the blind hole 28, also provided with a thread, of the central floor part 29.

Provided in the axial direction between a second element shoulder 36 of the head 20, as illustrated in FIG. 3, and an endface 37, facing away from the blind hole 28, of a centre cross-sectional constriction 38 of the stepped opening 26 is an axial spacing 39 so that the plug housing 2 can be moved with respect to the holding element 19 connected to the multipin plug 1 and thus with respect to the multipin plug 1 in the axial or vertical direction with play. An axial spacing 34 between the shoulder 33 formed at the junction of the cross-sectional constriction 38 with a region 41 of the opening 26 and the centre floor part 29 is larger than the axial spacing 39. This axial spacing 39 is delimited by the abutment of a plug endface 40 of the plug housing 2 facing away from the head 20 of the holding element 19 against the floor 35.

A radial play 42 is provided in the radial direction between the stepped opening 26 in its region 41 facing the floor 35 and the circumference of the circular-shaped central floor part 29. In addition, a radial play 43 is provided between the cross-sectional constriction 38 and the centre region 21 as well as a radial play 44 between the head 20 and a region 45 of the opening 26 surrounding the head 20. As a result, the plug housing 2 is freely movable with respect to the holding element 19 and also with respect to the multipin plug 1 in the radial or horizontal direction.

A plug-in or lock-in connection or a different connection between plug housing 2 and multipin plug 1 in order to ensure the horizontal and vertical mobility, according to the invention, of the plug housing 2 with respect to the multipin plug 1 is also possible.

Figure 2:
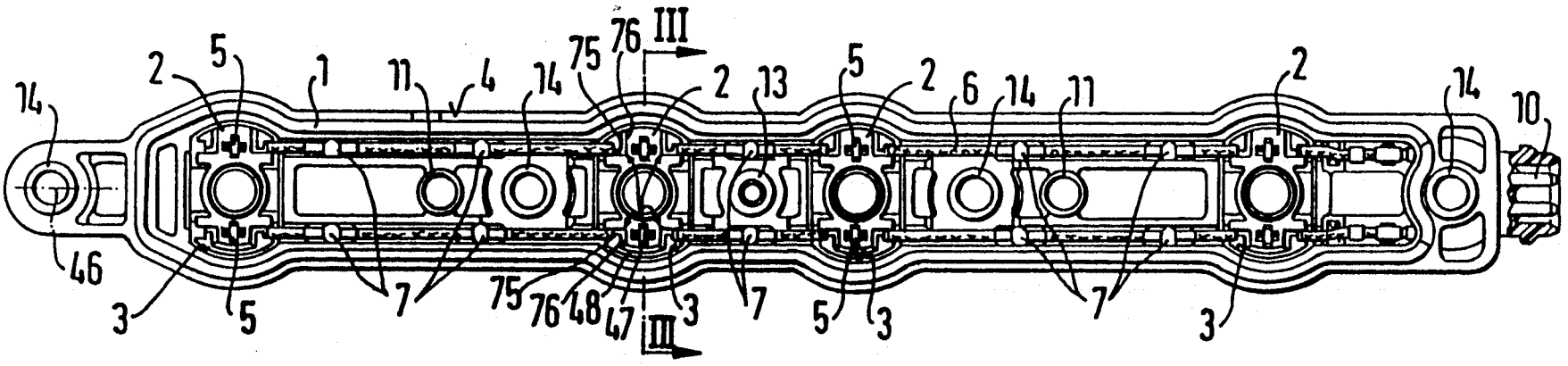

On the end facing away from the plug endface 40 of the plug housing 2 in the exemplary embodiment illustrated in FIGS. 2 and 3 are four positioning projections 47 which have a polygonal cross-sectional shape and are arranged at a distance from one another in such a way that in each case two projections are located on one side of a multipin plug longitudinal axis 46 and, to be precise, symmetrically with respect to the line III—III which runs through the first electrically conductive contacting elements 5. The position projections 47 are in the shape, for example, of a right angle and have parallel surfaces 75 in the longitudinal direction of the multipin plug 1 and parallel surfaces 76 perpendicular thereto. However, positioning projections 47 of rounded-off construction are also possible. A connection web 48 which connects the two positioning projections 47, located on one side of the multipin plug longitudinal axis 46, at their end facing away from the multipin plug longitudinal axis 47 is constructed on the plug housing 2 so that their two surfaces 76 are shorter than the surfaces 76 which extend on the other side of the multipin plug longitudinal axis 46 and terminate open at the end of the plug housing, that is to say with respect to the multipin plug longitudinal axis 46 of the multipin plug 1 the surfaces 76 and thus the positioning projections 47 are designed asymmetrically with respect to one another on different sides of the multipin plug longitudinal axis 46. In a similar way, the surfaces 76 of the positioning projections 47 could also be arranged in such a way that they have a smaller spacing from one another on one side of the multipin plug longitudinal axis 46 than the other side.

It is also possible to construct recesses on the end facing away from the plug endface 40 of the plug housing 2, which recesses cooperate with positioning projections constructed on the housing of an electromagnetically excitable element. In order to design the plug housing 2 asymmetrically with respect to the multipin plug longitudinal axis 46 of the multipin plug 1, these recesses are constructed differently by means of different geometrical dimensions. The positioning projections on the housing of the electrically excitable element which can be connected to the plug housing are then constructed in such a way that they can be inserted into these recesses.

The plug housing 2 has, for example, two stepped plug openings 49 which are open towards both sides and in which in each case a first electrically conductive contacting element 5 is mounted by engaging, for example, two locking noses 50 constructed on the first electrically conductive contacting element 5.

Figure 4:
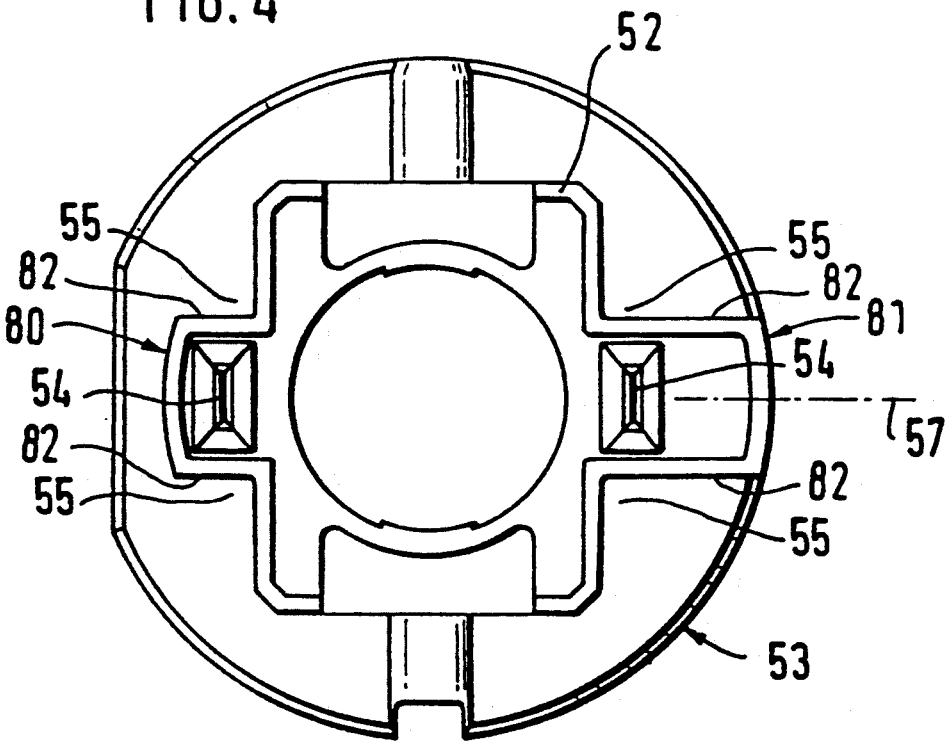
Figure 5:
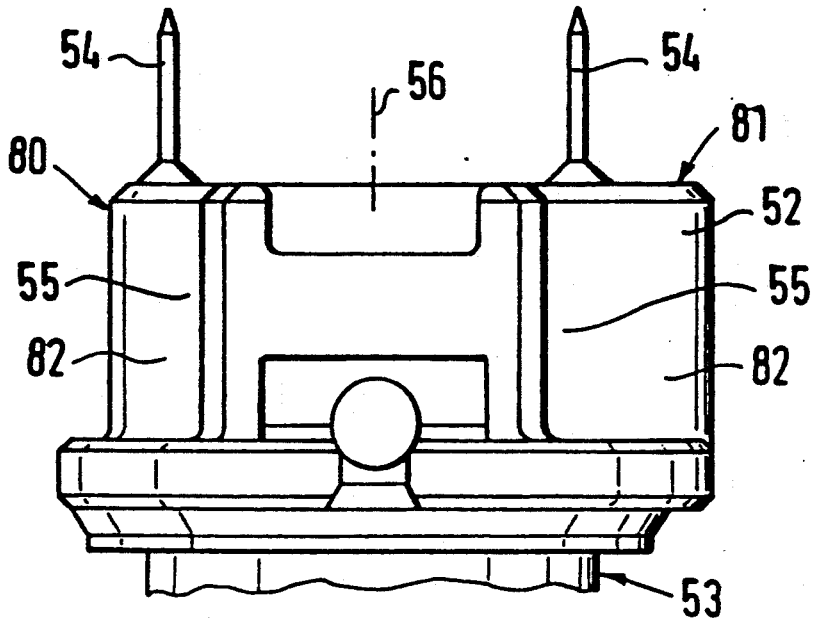

An upper housing component 52 of a fuel injection valve 53 is illustrated in FIGS. 4 and 5 as an example of an electrically excitable element of an internal combustion engine. The upper housing component 52 has for example two second electrically conductive contacting elements 54 which can be electrically conductively connected to the first electrically conductive contacting elements 5 of the plug housing 2. For the positioning projections 47 of the plug housing 2, recesses 55 into which the positioning projections 47 can engage are constructed on the upper housing component 52 of the fuel injection valve 53. Corresponding to the positioning projections 57, which are of asymmetrical construction with respect to the multipin plug longitudinal axis 46 of the multipin plug 1, in conjunction with the connection web 48 it is necessary also to make the recesses 55 on the upper housing component 53 asymmetrical with respect to a line running perpendicular to a connecting line 57 of the two second electrically conductive contacting elements 54. The recesses 55 must accordingly have enough space to receive the positioning projections 47 and the connection web 48. As a result, for example two projecting parts 80 and 81 are produced which surround the contacting elements 54 and are located on the connecting line 57. The projecting parts 80, 81 have parallel surfaces 82 which extend in the direction of a valve longitudinal axis 56 and are at such a distance that the projecting parts 80, 81 of the fuel injection valve 53 can be inserted between the positioning projections 47 of the plug housing 2. For this purpose, the parallel surfaces 82 of the projecting part 80 are also of shorter construction in the direction of the connecting line 57 than are the parallel surfaces 82 of the projecting part 81 in this direction so that the projecting parts 80, 81 are of asymmetrical construction with respect to the valve longitudinal axis 56.

The construction of the plug housing 2, which is effected by the connection web 48 and is asymmetrical with respect to the multipin plug longitudinal axis 46, and the corresponding construction of the upper housing component 52 gives rise to an effective polarity reversal protection for the fuel injection valve 53 so that the fuel injection valve 53 cannot be connected to the plug housing 2 and rotated through 180°.

The construction of the upper housing component 52 of the fuel injection valve 53 as described and illustrated can be carried out for example by means of an at least partial plastic injection moulding of the valve housing.

Instead of the flat contacting elements illustrated in the figures it is also possible to provide contacting elements which are round or of a different shape.

Figure 6:
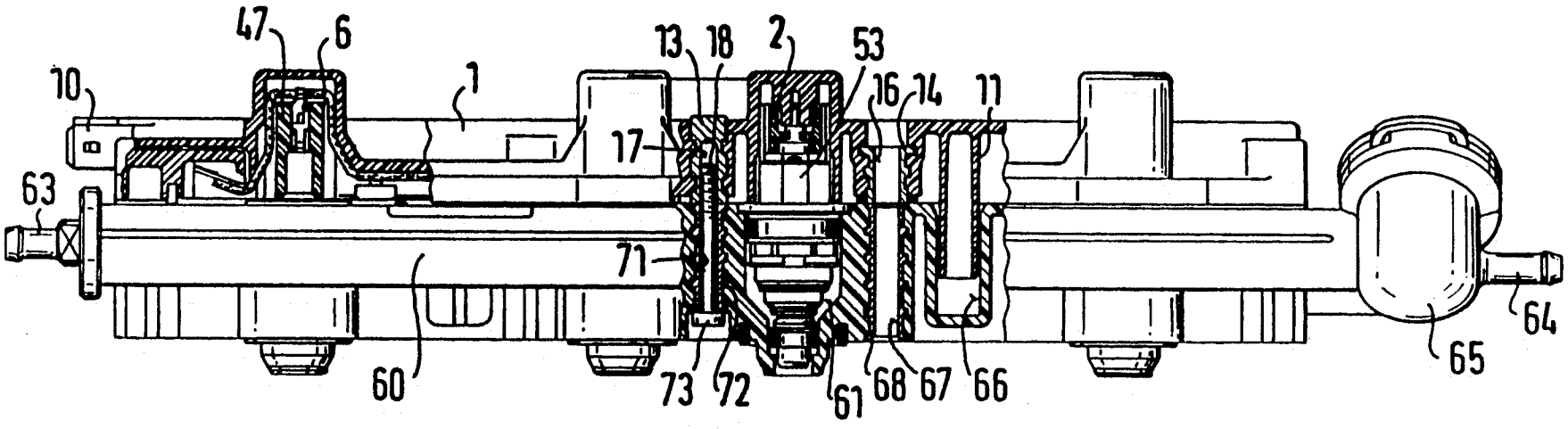

In FIG. 6, a fuel distributor element 60 corresponding essentially to that described in DE-OS 37 30 571 is illustrated, in whose stepped valve receiving openings 61, constructed at a distance from one another, in each case one fuel injection valve 53 is arranged which is surrounded by the valve receiving opening 61 which is open at both ends. The fuel injection valve 53 connects to at least one fuel line running in the fuel distributor element 60. The supply of the fuel into the fuel distributor element 60 and removal of it therefrom occurs by means of, for example, two connection pieces 63, 64 of the fuel distributor element 60. The system pressure of the fuel in the fuel distributor element 60 is controlled in a known manner by a pressure control 65 arranged on the fuel distributor element 60. The multipin plug 1 is connected to the fuel distributor element 60 in such a way that it covers the valve receiving openings 61 and the fuel injection valves 53 are held therein. The guide arms 11 of the multipin plug 1 serve for simpler mounting of multipin plug 1 and fuel distributor element 60 and engage in mounting openings 56 of the fuel distributor element 60. Concentric to the mounting openings 16 which are constructed in the multipin plug 1 and open towards both sides there are mounting openings 67 which are open towards both sides in the fuel distributor element 60 and are constructed for example by means of mounting bushings 68 arranged in the fuel distributor element 60. By means of these openings which extend both through the fuel distributor element 60 and through the multipin plug 1, the part consisting of fuel distributor element 60 and multipin plug 1 can be mounted jointly for example on a manifold or on a cylinder head of an internal combustion engine. For the purpose of premounting fuel distributor element 60 and multipin plug 1, an opening 71 is constructed, as illustrated in the exemplary embodiment, in the fuel distributor element 60 concentrically to the blind hole 17, having an inner thread 18, of the mounting bushing 13, for example by means of a mounting bushing 72. The head of a screw 73 which is screwed into the inner thread 18 of the blind hole 17 of the multipin plug 1 and thus connects the multipin plug 1 and the fuel distributor element 60 to one another rests against an end side of the mounting bushing 72 facing away from the multipin plug 1.

The fuel injection valves 53 arranged in the fuel distributor element 60 can inject for example directly into the cylinders of an internal combustion engine or into a manifold of an internal combustion engine.

It is also possible to arrange the fuel injection valves 53 directly on a manifold having receiving openings for fuel injection valves and connection elements and lines for the fuel supply or on a cylinder head which is also constructed in this manner and to provide joint electrical contacts between the fuel injection valves and the multipin plug 1 according to the invention.

The multipin plug 1 according to the invention permits the plug housing 2 to be movable with respect to the multipin plug 1 both in the horizontal and in the vertical direction. Thus, shape and position tolerances between the first electrically conductive contacting elements 5 of the plug housings 2 and the second electrically conductive contacting elements 54, for example of the fuel injection valves 53, can be compensated. However, the multipin plug 1 according to the invention is, of course, also suitable for providing contacts to other electrically excitable elements, for example the spark plugs of an internal combustion engine with externally supplied ignition or the heater plugs of an internal combustion engine with auto-ignition.

The foregoing relates to preferred exemplary embodiments of the invention, it being understood that other variants and embodiments thereof are possible within the spirit and scope of the invention, the latter being defined by the appended claims.

We claim:

1. A multipin plug for electrically joining a plurality of electrically excitable fuel injection valves of an internal combustion engine, comprising at least one plug housing arranged in said multipin plug in which first electrically conductive contacting elements are arranged which are connected to second electrically conductive contacting elements of one element by plugging in, each plug housing (2) is arranged in the multipin plug (1) in such a way that said plug housing is floatingly movable with respect to the multipin plug (1) in a horizontal and in a vertical direction.

2. A multipin plug for electrically joining a plurality of electromagnetically actuable fuel injection valves of an internal combustion engine having plug housings arranged therein in which first electrically conductive contacting elements are arranged to be connected to second electrically conductive contacting elements of a plurality of fuel injection valves by plugging in, the fuel injection valves being arranged in stepped valve receiving openings of a fuel distributor element at a distance from one another, each receiving opening being open at both ends and surrounding in each case one fuel injection valve, said fuel injection valves being connected to at least one fuel line, which line runs in the fuel distributor element to which the multipin plug is connected in such a way that receiving openings are covered and the fuel injection valves are held therein, each plug housing (21) is arranged in the multipin plug (1) in such a way that it is floatingly movable with respect to the multipin plug (1) in a horizontal and in a vertical direction.

3. A multipin plug according to claim 1, in which a holding element is mounted on the multipin plug (1), said holding element (19) engages through an opening (26) of the plug housing (2) with radial play (42–44) and at an axial distance (39), and with a head (20) delimits an axial mobility of the plug housing (2) with respect to the multipin plug (1).

4. A multipin plug according to claim 2, in which a holding element is mounted on the multipin plug (1), said holding element (19) engages through an opening (26) of the plug housing (2) with radial play (42–44) and at an axial distance (39), and with a head (20) delimits an axial mobility of the plug housing (2) with respect to the multipin plug (1).

5. A multipin plug according to claim 3, in which the plug housing (2) is held, by means of the holding element (19) mounted in a blind hole (28) of a central floor part (29) of a receiving opening (3) of the multipin plug (1) constructed to receive the plug housing (2).

6. A multipin plug according to claim 4, in which the plug housing (2) is held, by means of the holding element (19) mounted in a blind hole (28) of a central floor part (29) of a receiving opening (3) of the multipin plug (1) constructed to receive the plug housing (2).

7. A multipin plug according to claim 1, in which the plug housing (2) is inserted into a receiving opening (3) of the multipin plug (1) constructed to receive the plug housing (2) and is connected by means of a snap-in connection to the multipin plug (1).

8. A multipin plug according to claim 2, in which the plug housing (2) is inserted into a receiving opening (3) of the multipin plug (1) constructed to receive the plug housing (2) and is connected by means of a snap-in connection to the multipin plug (1).

9. A multipin plug according to claim 3, in which the plug housing (2) is inserted into a receiving opening (3) of the multipin plug (1) constructed to receive the plug housing (2) and is connected by means of a snap-in connection to the multipin plug (1).

10. A multipin plug according to claim 1, in which at least one positioning projection (47) which determines a position of the electrically conductive contacting element or the fuel injection valve (53) with respect to the plug housing (2) is constructed on the plug housing (2) and extends from the circumference of the plug housing (2) in the axial direction and cooperates with at least one recess (55) arranged on the element or fuel injection valve (53).

11. A multipin plug according to claim 2, in which at least one positioning projection (47) which determines a position of the electrically conductive contacting element or the fuel injection valve (53) with respect to the plug housing (2) is constructed on the plug housing (2) and extends from the circumference of the plug housing (2) in the axial direction and cooperates with at least one recess (55) arranged on the element or fuel injection valve (53).

12. A multipin plug according to claim 3, in which at least one positioning projection (47) which determines a position of the electrically conductive contacting element or the fuel injection valve (53) with respect to the plug housing (2) is constructed on the plug housing (2) and extends from the circumference of the plug housing (2) in the axial direction and cooperates with at least one recess (55) arranged on the element or fuel injection valve (53).

13. A multipin plug according to claim 5, in which at least one positioning projection (47) which determines a position of the electrically conductive contacting element or the fuel injection valve (53) with respect to the plug housing (2 is constructed on the plug housing (2) and extends from the circumference of the plug housing (2) in the axial direction and cooperates with at least one recess (55) arranged on the element or fuel injection valve (53).

14. A multipin plug according to claim 7, in which at least one positioning projection (47) which determines a position of the electrically conductive contacting element or the fuel injection valve (53) with respect to the plug housing (2) is constructed on the plug housing (2) and extends from the circumference of the plug housing (2) in the axial direction and cooperates with at least one recess (55) arranged on the element or fuel injection valve (53).

15. A multipin plug according to claim 1, in which at least one recess is constructed on the plug housing (2) and cooperates with at least one positioning projection which is constructed on the element or fuel injection valve (53) having second electrically conductive contacting elements.

16. A multipin plug according to claim 2, in which at least one recess is constructed on the plug housing (2) and cooperates with at least one positioning projection which is constructed on the element or fuel injection valve (53) having second electrically conductive contacting elements.

17. A multipin plug according to claim 3, in which at least one recess is constructed on the plug housing (2) and cooperates with at least one positioning projection which is constructed on the element or fuel injection valve (53) having second electrically conductive contacting elements.

18. A multipin plug according to claim 5, in which at least one recess is constructed on the plug housing (2) and cooperates with at least one positioning projection which is constructed on the element or fuel injection valve (53) having second electrically conductive contacting elements.

19. A multipin plug according to claim 7, in which at least one recess is constructed on the plug housing (2) and cooperates with at least one positioning projection which is constructed on the element or fuel injection valve (53) having second electrically conductive contacting elements.

20. A multipin plug according to claim 10, in which for the purposes of positioning the element or the fuel injection valve (53) and the plug housing (2) at least two positioning projections (47) and at last two recesses (55) are provided which are of asymmetrical design with respect to a multipin plug longitudinal axis (46) of the multipin plug (1).

21. A multipin plug according to claim 15, in which for the purposes of positioning the element or the fuel injection valve (53) and the plug housing (2) at least two positioning projections (47) and at last two recesses (55) are provided which are of asymmetrical design with respect to a multipin plug longitudinal axis (46) of the multipin plug (1).

22. A multipin plug according to claim 1, in which the first electrically conductive contacting element (5) can be mounted in plug openings (49) of the plug housing (2) by engaging locking noses (50) constructed on the first electrically conductive contacting elements (5).

23. A multipin plug according to claim 2, in which the first electrically conductive contacting element (5) can be mounted in plug openings (49) on the plug housing (2) by engaging locking noses (50) constructed on the first electrically conductive contacting elements (5).

24. A multipin plug according to claim 1, in which the multipin plug (1) is constructed from a plastic.

25. A multipin plug according to claim 2, in which the multipin plug (1) is constructed from a plastic.

26. A multipin plug according to claim 25, in which an electrical conductor (6) which runs in the multipin plug (1) and is electrically conductively connected to the first electrically conductive contacting element (5) of the plug housings (2) is mechanically connected to the multipin plug (1).

27. A multipin plug according to claim 26, in which the electrical conductor (6) is connected at at least one support point (7) of the multipin plug (1) to the multipin plug (1) by caulking multipin plug material by means of ultrasonic welding.

* * * * *